United States Patent [19]

Liesinger

[11] 4,286,717

[45] Sep. 1, 1981

[54] HANGER FOR SLENDER ARTICLES

[76] Inventor: James O. Liesinger, 4543 Snelling Ave. South, Minneapolis, Minn. 55402

[21] Appl. No.: 84,798

[22] Filed: Oct. 15, 1979

[51] Int. Cl.[3] ..... A47F 7/00

[52] U.S. Cl. ..... 211/60 T; 211/89; 248/110

[58] Field of Search ..... 211/66, 63, 60 T, 65, 211/68, 60 R, 89; 248/110, 111, 113, 314

[56] References Cited

U.S. PATENT DOCUMENTS

| | | | |
|---|---|---|---|
| 104,787 | 6/1870 | Snow et al. | 248/111 |
| 350,523 | 10/1886 | Bodley | 211/65 |
| 552,921 | 1/1896 | Miner | 248/111 |
| 673,430 | 5/1901 | Flanders | 248/113 X |
| 928,284 | 7/1909 | Selsor . | |
| 1,206,655 | 11/1916 | Belcher | 211/66 UX |
| 1,299,575 | 4/1919 | Holmes | 248/113 X |
| 1,323,996 | 12/1919 | Yearwood . | |
| 2,422,891 | 6/1947 | Dickson . | |
| 2,491,652 | 12/1949 | Feerick . | |
| 2,623,642 | 12/1952 | Looney . | |
| 2,911,173 | 11/1959 | Deppe . | |
| 2,945,251 | 7/1960 | Eichner | 211/65 X |
| 3,096,960 | 7/1963 | Kinney | 248/113 |
| 3,163,479 | 12/1964 | Vertrees | 211/89 X |
| 3,305,100 | 2/1967 | Barbee | 211/60 T |
| 3,603,551 | 9/1971 | Peterson | 211/89 X |
| 3,650,502 | 3/1972 | Langhl . | |
| 3,712,263 | 1/1973 | Faragosa . | |

*Primary Examiner*—J. Franklin Foss
*Attorney, Agent, or Firm*—Burd, Bartz & Gutenkauf

[57] ABSTRACT

A holder for supporting an object, as a hand tool, having an elongated cylindrical handle. The holder has a plate adapted to be attached to a support. A tubular member attached to the plate has a passage and open ends accommodate a portion of the handle. A section of the tubular member is cut out providing a side opening surrounded by inwardly converging edges. The edges are joined with rounded bottoms located in opposite portions of the tubular member. A coil tension spring extended across the side opening has opposite hook ends connected to the plate. The mid-section of the spring engages the handle and biases the handle into friction holding engagement with the tubular member.

40 Claims, 17 Drawing Figures

Fig. 1
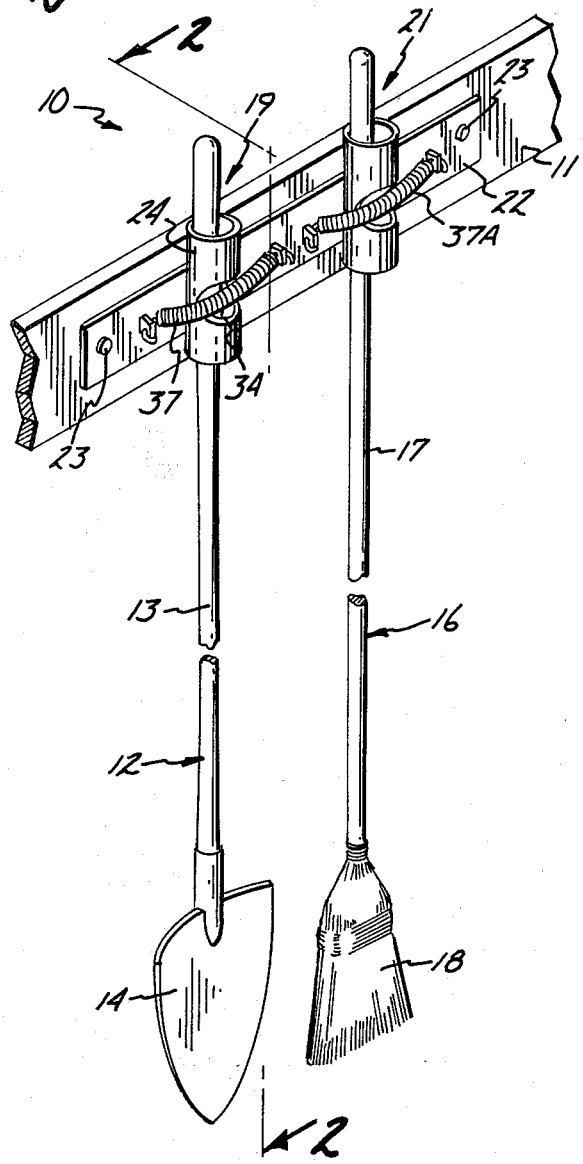
Fig. 2
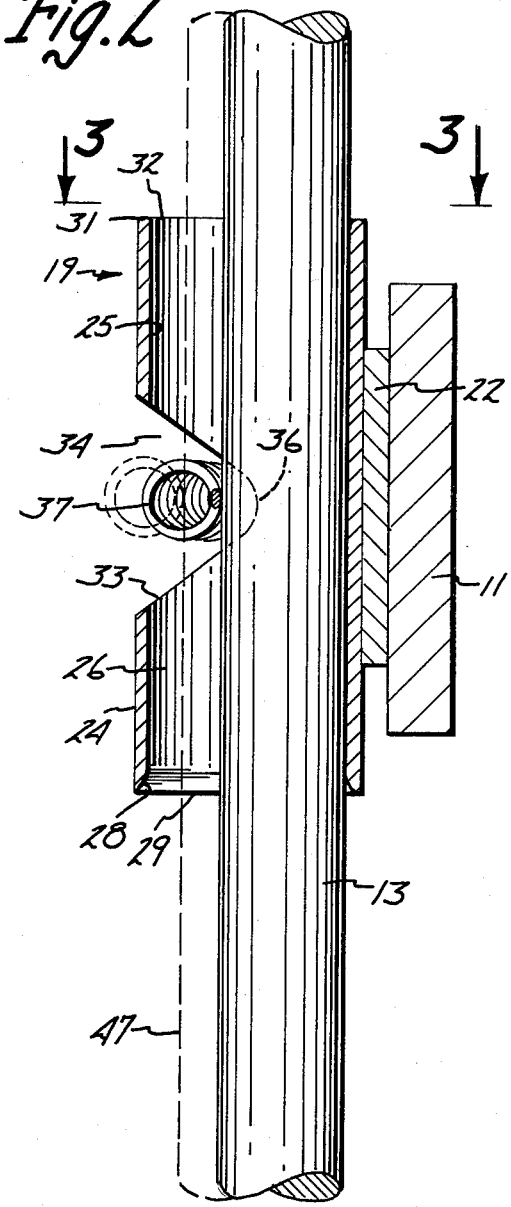
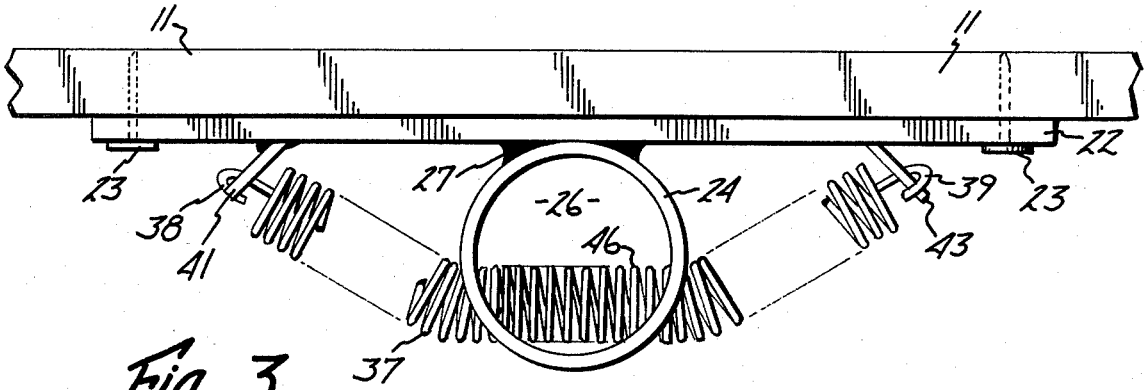
Fig. 3

Fig. 4
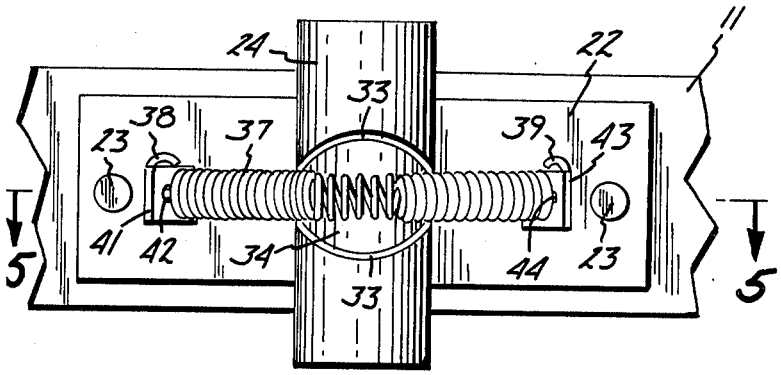
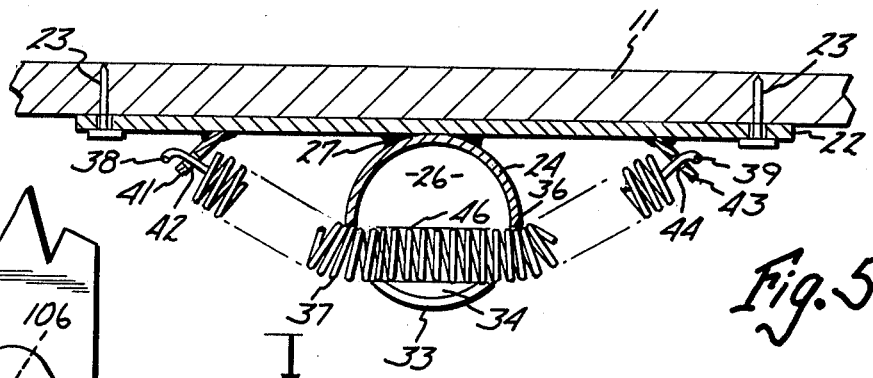
Fig. 5
Fig. 6
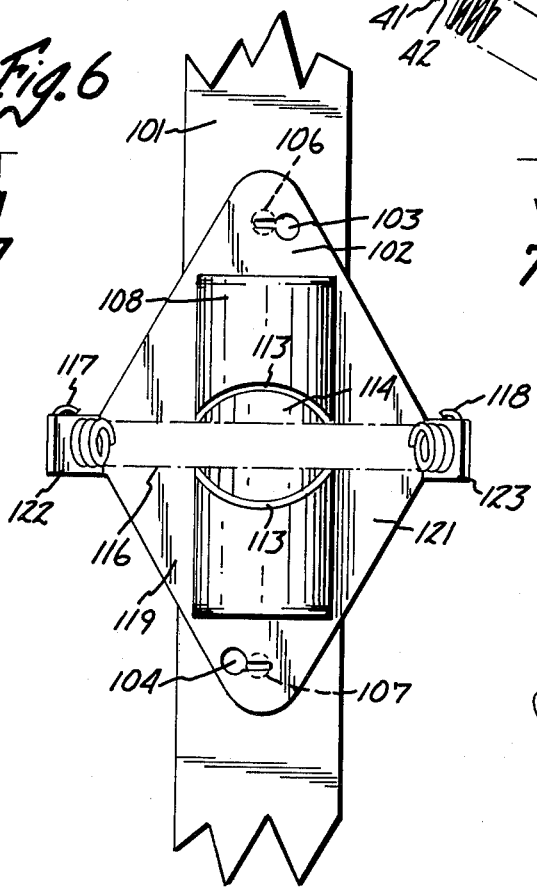
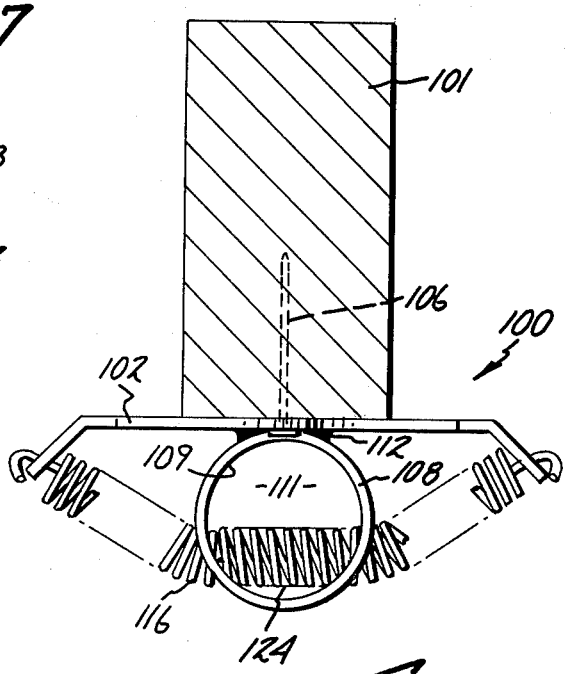
Fig. 7

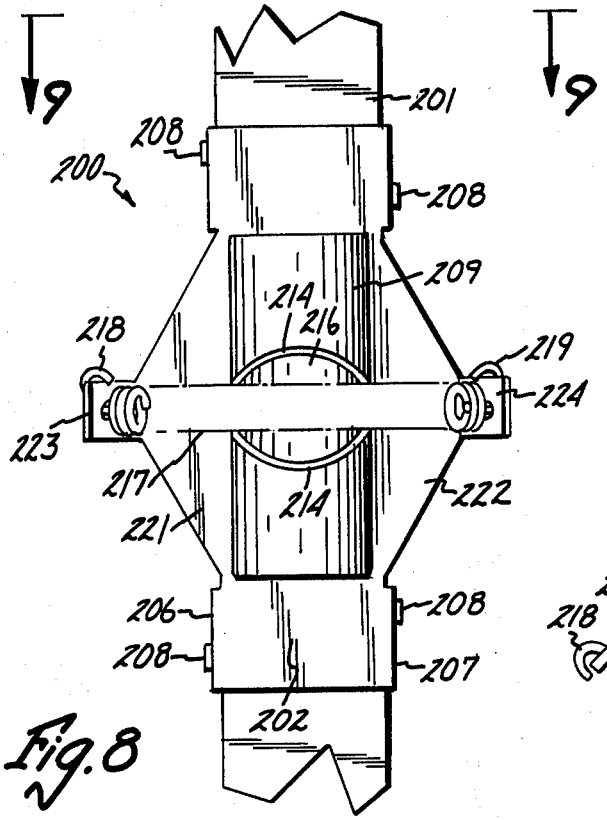
Fig. 8
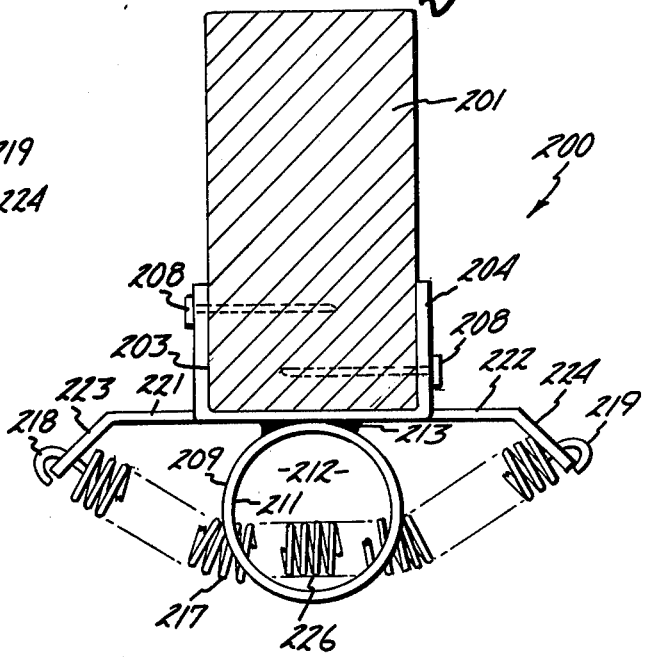
Fig. 9
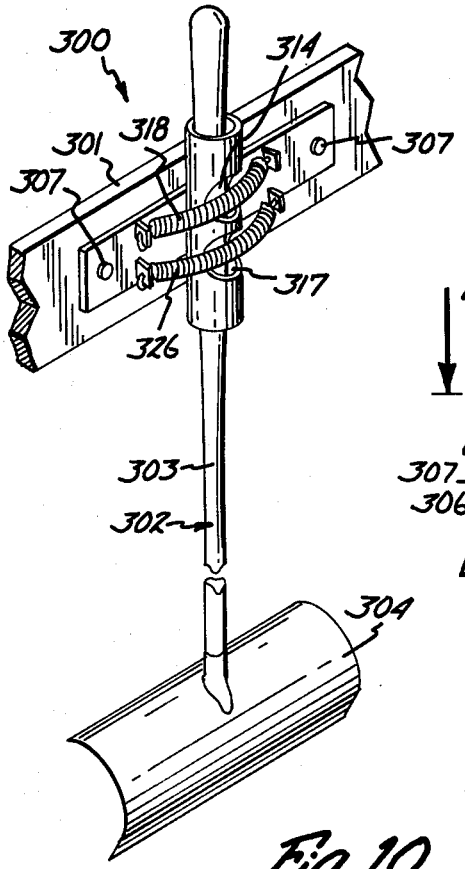
Fig. 10
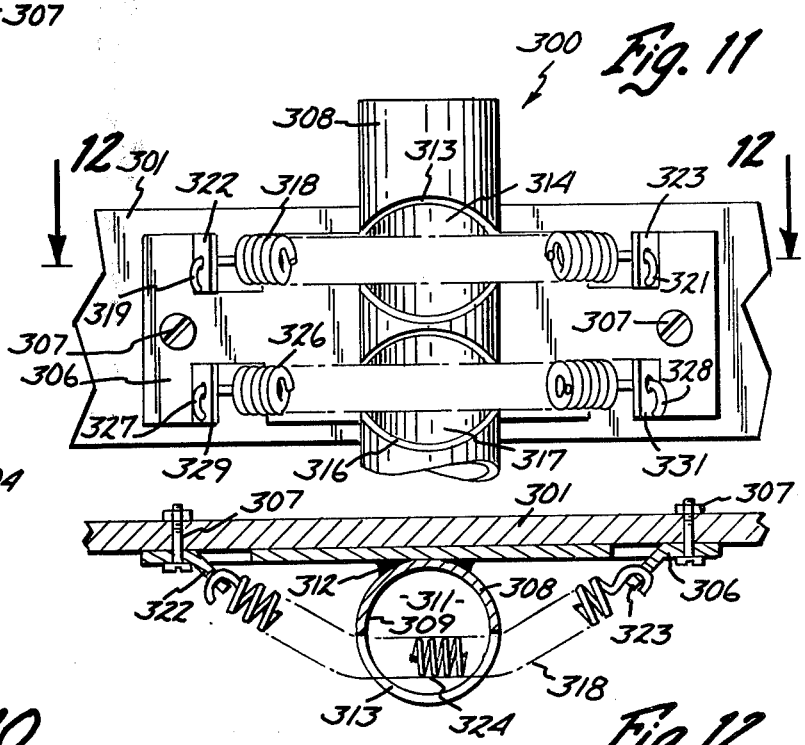
Fig. 11
Fig. 12

HANGER FOR SLENDER ARTICLES

SUMMARY OF INVENTION

The invention relates to a holder for objects with handles, as hand tools, household mops, brooms, brushes, recreational equipment, as hockey sticks, baseball bats, tennis rackets, agricultural hand tools, as forks, shovels, rods, pipes, and the like. The holder has means adapted to be attached to a support. Flanges, holes, or keyhole slots incorporated in the means facilitate attachment to the support. The tubular means secured to the means has a passage of a size to accommodate a handle or similar shaped cylindrical member. The tubular means has open ends which allow the handle to be inserted into the passage. A biasing means holds the handle in the passage. The tubular means has a side opening surrounded with inwardly converging edges joined with bottoms. The bottoms are located on opposite sides of the tubular means. The biasing means includes a coil spring extended across the side opening. The coil spring has hook ends attached to the means attached to the support to hold the spring under tension. The converging edges locate the spring in engagement with the bottoms with the mid-section of the spring extended across the passage. When the handle is pushed up into the passage the coil spring is forced outward biasing the handle into holding engagement with the tubular means. In one form of the holder, the tubular means has a pair of side openings and a coil spring extended across each opening. The coil springs cooperate to bias the handle into holding engagement with the tubular means.

The holder is sturdy in construction and versatile in use. The size of the passage of the tubular means can be changed to accommodate different size objects. The object is placed in the holder by moving the object into the passage through an open end and removed therefrom by moving the object out of the passage. All parts of the holder remain assembled during use and insertion and removal of the object from the holder. These and other advantages of the holder are embodied in the following examples of the holder.

IN THE DRAWINGS

FIG. 1 is a perspective view of a tool holding assembly having two tool holders of the invention;

FIG. 2 is an enlarged sectional view taken along the line 2—2 of FIG. 1;

FIG. 3 is a sectional view taken along the line 3—3 of FIG. 2 with the shovel handle removed from the holder;

FIG. 4 is a front elevational view of a tool holder of FIG. 1;

FIG. 5 is a sectional view taken along the line 5—5 of FIG. 4;

FIG. 6 is a front elevational view of a first modification of the tool holder;

FIG. 7 is a sectional view taken along the line 7—7 of FIG. 6;

FIG. 8 is a front elevational view of a second modification of the tool holder;

FIG. 9 is a sectional view taken along the line 9—9 of FIG. 8;

FIG. 10 is a perspective view of a third modification of the tool holder supporting a snow blade;

FIG. 11 is a front elevational view of the holder of FIG. 10;

FIG. 12 is a sectional view taken along the line 12—12 of FIG. 11;

DESCRIPTION OF PREFERRED EMBODIMENTS

Figure 13:
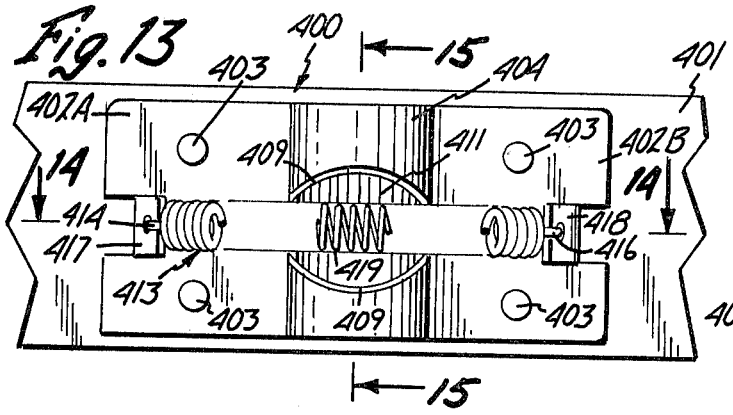
FIG. 13 is a front elevational view of a fourth modification of the tool holder.

Referring to FIG. 1, there is shown a tool holding assembly indicated generally at 10 mounted on a support 11, such as a structural member as a 2×4 or 2×6. Other types of supports can be used to hold the tool holding assembly in a stationary position. Tool holding assembly 10 is shown holding an upright shovel indicated generally at 12 and broom 16. Shovel 12 has an elongated linear handle 13 and a bottom blade 14. Broom 16 has an upright linear handle 17 attached to a sweeping head 18 comprising a plurality of bristles. Other types of brooms can be attached to handle 17. The shovel 12 and broom 16 are shown as examples of types of hand tools that can be held in the tool holding assembly. Other objects and hand tools having handles, such as garden hoes, rakes, forks, shovels, mops, post hole diggers, hammers, fishing nets, rods, pipes, baseball bats, tennis rackets, and hockey sticks, can be supported by holding assembly 10. The use of holding assembly 10 or the type of objects supported by the holding assembly is not limited by a particular objects. The object is characterized with an elongated member, as a linear handle of a size to be retained in the holding assembly.

Holding assembly 10 has a first holder 19 for holding shovel 12 in an upright position and a second holder 21 for holding broom 16. Holders 19 and 21 are attached to a generally flat plate 22. Plate 22 is a support means that is connected to support 11 with a plurality of fasteners 23, such as nails, screws, or bolts. FIG. 1 shows two holders 19 and 21 attached to plate 22. Additional holders can be attached to plate 22. The length of plate 22 can vary to accommodate additional holders.

Holders 19 and 21 are identical in structure. The following description is limited to holder 19. The structure of holder 21 that corresponds to the structure of tool holder 19 has the same reference numeral with the suffix "A".

Referring to FIGS. 2-5, there is shown holder 19 mounted in an upright position. Tool holder 19 can be mounted in an inclined or horizontal position to accommodate the handle of a tool or any other linear object, such as a pipe. Holder 19 has a tubular member or pipe 24 made of metal, plastic, or similar rigid material. Member 24 has an inside cylindrical wall 25 surrounding a passage 26. Welds 27, as shown in FIG. 3, secure tubular member 24 to plate 22. Other types of fastening means can be used to secure tubular member 24 to plate 22. Alternatively, plate 22 and tubular member 24 can be one-piece metal or plastic that is formed or extruded.

As shown in FIG. 2, tubular member 24 has an inlet or lower end 28 surrounding an opening or mouth 29. End 28 has a rounded external beveled surface to facilitate the movement of handle 13 into passage 26. The upper end 31 of tubular member 24 surrounds an open upper or outlet end 32 of passage 26. Upper end 32 is open so that handle 13 can be retained in holder 19 at a selected position. Alternatively, the upper end of tubular member 24 can be closed.

As shown in FIGS. 2, 4, and 5, the mid-section of tubular member 24 is cut out and has a generally V-shaped edge 33 which surrounds an opening or slot 34. Edge 33 diverges and is joined to rounded concave bottoms 36. Bottoms 36 are located about half-way through tubular member 24 or generally along a line extended through the diameter of passage 26. Edge 33 diverges outwardly from rounded bottom 36 at an angle between 75 and 95 degrees. Edge 33 can diverge at other angles to form opening or slot 34.

A handle retaining means shown as an elastic biasing member 37 extends across opening 34. Biasing means 37 is an elongated coil spring 37. The biasing means 37 can be a rubber or elastic member, wire, strap, or bungi cord. Coil spring 37 has hooked ends 38 and 39. Hook 38 is connected to an ear or tab 41 having a hole 42 for accommodating the hook 38. Ear 41 is secured to plate 22. Hook 39 is connected to an ear or tab 43. Tab 43 has a hole 44 accommodating hook 39. Ears 41 and 43 can be secured by welds to plate 22. Alternatively, ears 41 and 43 can be bent up portions of plate 22. The mid-section 46 of spring 37 extends across the mid-section of passage 26. As shown in FIGS. 2 and 5, spring 37 rests on the rounded concave bottoms 36 and has an inner edge that extends substantially along the diameter line of passage 26. Spring 46 can extend across a cord section of the passage 26. The V-shaped edge 33 guides and centers spring 37 toward rounded bottoms 36.

A specific example of the holder is as follows. Plate 22 is a 2.5×20 cm. metal plate having holes at opposite ends for attaching the plate to a support. Tubular member 24 is a metal pipe having a length of 10 cm. and an i.d. of 3.5 cm. Edges 33 diverge 90 degrees from the rounded bottoms 36. Each bottom 36 has a radius of 1 cm. The rounded bottom 36 extends half-way through pipe 24. Spring 37 is a coil metal spring having a length of 10 cm. and an o.d. of 1.5 cm. Opposite ends of spring 37 have hooks 38 and 39 that are connected to tabs 41 and 43 secured to plate 22. When spring 37 is connected to ears 41 and 43 it is stretched or under tension.

In use, holder 19 is mounted on a frame or supporting structure, such as support 11, by attaching plate 22 to the support. Holder 19 can be used in an upright position, as shown in FIGS. 1 and 2, or horizontal or angular position to support objects, such as hand tools having elongated rod-like or cylindrical handles. A plurality of holders can be attached to plate 22 so that a number of objects can be supported. FIG. 1 shows a pair of holders 19 and 21 mounted on plate 22. A single holder, as shown in FIG. 4, can be mounted on plate 22. Shovel 12 is placed in holder 14 by moving handle 13 in an upward direction through open inlet mouth 29 into passage 26. The upper handle 13 engages the mid-section 46 of spring 37, since the mid-section of the spring extends across passage 26, as shown in FIG. 3. Upward movement of handle 13 forces the mid-section 37 of spring 37 in an outward direction so that the spring biases a linear portion of the handle against inside wall 25 of tubular member 24. The circular shape of spring 37 bearing against the upper end of handle 13 facilitates the insertion of the handle into passage 26 of tubular member 24. Passage 26 can accommodate handles of different diameters. The maximum sized handle is dependent on the inside diameter of tubular member 24. Spring 37 will be biased in an outward direction by a larger sized handle, as shown by broken lines 47 in FIG. 2. The biasing force or holding force of spring 37 on the handle increases with the size of the handle because spring 37 will have greater deflection.

Referring to FIGS. 6 and 7, there is shown a first modification of the holder indicated generally at 100 mounted on an upright stud 101, such as a 2×4. Holder 100 can be mounted on other supporting structures. Holder 100 has a back plate or support 102 having upper and lower portions containing keyhole slots 103 and 104. Fasteners 106 and 107, as nails, screws, bolts, and the like, extend through the keyhole slots and secure the holder to stud 101. Holder 100 has a tubular member or pipe 108 having an inside cylindrical wall 109 defining a passage 111. Passage 111 extends through the tubular member 108. Fastening means, such as welds 112, secure tubular member 108 to plate 102.

The mid-portion of tubular member 108 has divergent edges 113 forming an opening or slot 114. Edges 113 extend to the approximate mid-section of the opposite sides of tubular member 108.

An elongated biasing means shown as a coil tension spring 116 extends across opening 114. The biasing means can be rubber, plastic band or rod, or bungi cord. Spring 116 has end hooks 117 and 118. Plate 102 has oppositely extended side sections or arms 119 and 121 having fingers or tabs 122 and 123, respectively. Tab 122 joined to arm 119 has a hole for accommodating the spring hook 117. Tab 123 has a hole for accommodating the spring hook 118. When spring hook 117 is connected to tabs 122 and 123, it is under tension and has a mid-section 124 that extends across the passage 111, as shown in FIG. 7. The mid-section 124 functions to bias the handle of the tool or rod moved into passage 111 into holding engagement with inside wall 109.

Referring to FIGS. 8 and 9, there is shown a second modification of the holder indicated generally at 200 mounted on an upright stud or support 201. Stud 201 can be a 2×4 or 2×6 of a structure, such as a garage or storage shelter for tools. Holder 200 has a back plate or support 202 that engages stud 201. The upper end of plate 202 has inwardly directed side flanges 203 and 204 located adjacent opposite sides of stud 201. The lower end has similar side flanges 206 and 207 located adjacent opposite sides of stud 201. Fasteners 208, such as nails, screws, bolts, and the like, extend through suitable holes through the flanges 203, 204, 206, and 207 and into stud 201.

Holder 200 has a tubular member or body 209 having a generally cylindrical inside wall 211 surrounding passage 212 extended through the body. Welds 213 secure tubular member 209 to plate 202 and align the tubular member 209 in the longitudinal plane of stud 201.

The mid-section of tubular member 209 has diverging edges 214 forming an opening or slot 216. Slot 216 extends approximately to the diameter of tubular member 209. Edges 214 are angularly disposed relative to each other and at an angle of approximately 90 degrees and converge to rounded bottoms.

Biasing means 217, shown as a tension coil spring, extends across opening 216. Spring 217 has end hooks 218 and 219. Plate 202 has opposite side sections or arms 221 and 222 having upwardly and outwardly directed fingers or tabs 223 and 224, respectively. Finger 223 has a hole for accommodating end hook 218. Finger 224 joined to side section 222 has a hole accommodating hook end 219. When spring 217 is attached to the fingers 223 and 224, it is under tension and has a center or mid-section 226 that extends across a portion of passage 212. In use, the mid-portion of spring 226 engages a rod or handle to hold the rod in a retaining relation relative to inside wall 211.

Referring to FIGS. 10, 11, and 12, there is shown a third modification of a holder indicated generally at 300 supporting a snow shovel or blade 302. Holder 300 is mounted on a stationary support 301. Snow blade 302 has an upright linear handle 303 connected to a transverse curved blade 304.

Holder 300 has a generally flat backing plate or support 306 having suitable holes for accommodating fasteners 307, such as nut and bolt assemblies, nails, screws, and the like, for securing plate 306 to support 301. A tubular member or body 308 having an inside cylindrical wall 309 surrounding a passage 311 is attached to backing plate 306 with welds 312. Other means may be used to attach tubular member 308 to plate 306.

Tubular member 308 has a pair of diverging first edges 313 forming a first opening or slot 314 in a portion of tubular member 308. Opening 314 extends to approximately the mid-section of the tubular member 308. A second pair of edges 316 form a second opening or slot 317 in tubular member 308. Second slot 317 extends to the opposite mid-portions of the tubular member 308. A first biasing means, shown as a spring 318, extends across first slot 314. Spring 318 has end hooks 319 and 321 that extend through holes in tabs or fingers 322 and 323, respectively. Tabs 322 and 323 are bent up portions of backing plate 306 and are located on opposite sides of tubular member 308. Spring 318 has a mid-section 324, as shown in FIG. 12, that is under tension and extends across the passage 311 and biases a portion of the handle 303 into engagement with inside wall 309. A second biasing means, shown as a coil tension spring 326, extends across opening 317, as shown in FIG. 11. The spring 326 has end hooks 327 and 328 that extend through holes in upright tabs or fingers 329 and 331. The mid-section of spring 326 is under tension and extends across passage 311 below spring 318. Tabs 329 and 331 are bent up portions of backing plate 306. The first and second biasing means 318 and 326 cooperate together to bias handle 303 into retaining engagement with the back portion of inside wall 309. The two biasing means have a substantial biasing or holding force that can hold relatively heavy tools.

Figure 14:
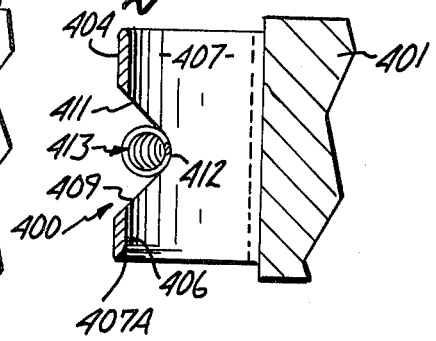
FIG. 14 is a sectional view taken along the line 14—14 of FIG. 13.
Figure 15:
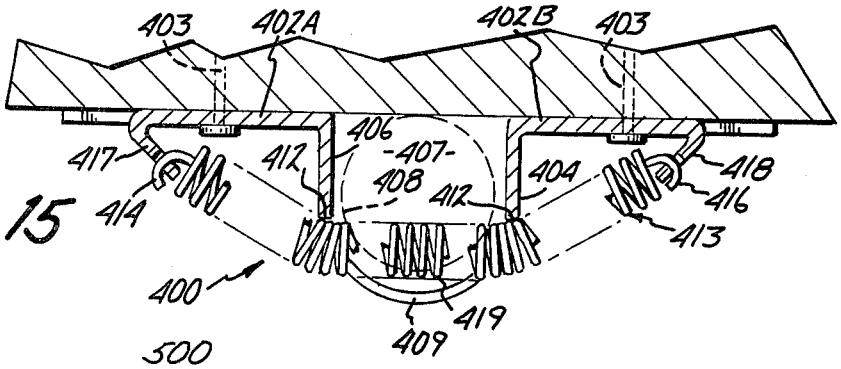
FIG. 15 is a sectional view taken along the line 15—15.

Referring to FIGS. 13–15, there is shown a fourth modification of the tool holder indicated generally at 400 mounted on a support structure 401. Support structure 401 can be a vertical wall including plywood or a horizontal structure. Holder 400 has a back or plate means 402 attached with fasteners 403, such as nails, screws, nut and bolt assemblies, and the like to support structure 401. Plate means 402 include support members 402A and 402B having holes for accommodating fasteners 403.

Figure 16:
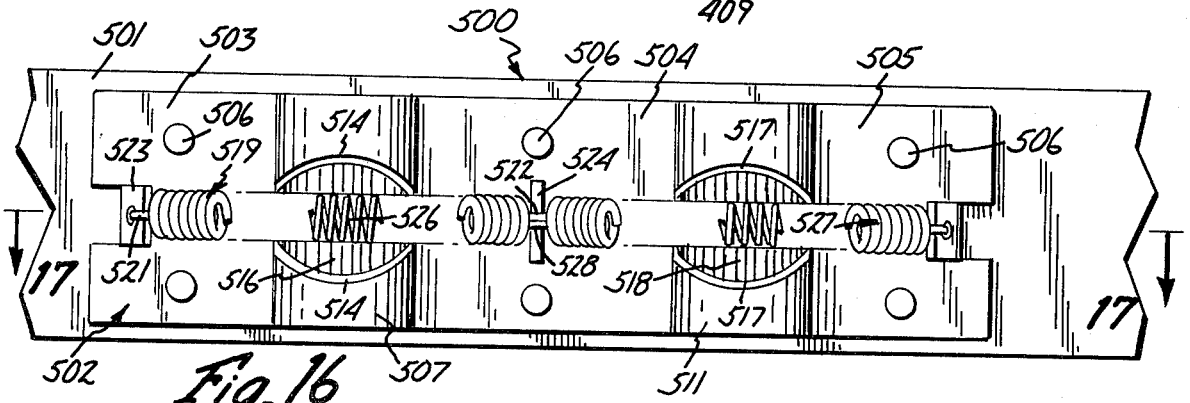
FIG. 16 is a front elevational view of a fifth modification of the tool holder.

A tubular member or body 404 is joined to support member 402A and 402B. Body 404 has an inside arcuately curved wall 406 and a passage 407. Opposite ends of passage 407 are open to accommodate an elongated member, such as a handle of a hand tool. As shown in FIG. 16, the bottom of body 404 has an arcuate lip 407A. The lip has an inwardly and upwardly tapered surface to facilitate the insertion of the tool handle into passage 407. A handle 408 is indicated in dotted lines in FIG. 15.

The mid-portion of body 404 has a pair of edges 409 formed by cutting out a section of the body. The edges 409 diverge outwardly from opposite sides of the body and are joined with rounded concave bottoms 412. The edges 409 provide body 404 with a front opening 41. Opening 411, as shown in FIG. 15, extends approximately to the mid-portion of the opposite sides of body 404.

An elongated biasing means indicated at 413 extends through opening 411 and is connected at its opposite ends to tabs or fingers 417 and 418. Means 413 is a tension coil spring having end hooks 414 and 416. Hook 414 extends through a hole in tab 417. Hook 416 extends through a hole in tab 418. The mid-section 419 of the spring is under tension and extends across opening 411. The inwardly converging edges 409 center the coil spring to the lowermost portion of the opening into engagement with rounded bottoms 412.

Support members 402A and 402B, body 404, and tabs 417 and 418 are formed from a single piece of metal. Body 404 is formed by bending the mid-section of the metal blank into a generally U-shaped configuration. The tabs 417 and 418 are bent portions of opposite edges of the body. The opening 411 is formed by cutting out a mid-section of body 404. The holder 400 can be made of other materials, such as plastic, wood, sheet metal, and the like.

In use, fasteners 403 attach the holder 400 to the support 401. Handle 408 is moved up through the bottom opening of passage 407. The circular shaped spring 413 facilitates the movement of the handle up into the passage and moves the mid-section 419 of spring 413 in an outward direction. The spring 413, being under tension, biases the handle into engagement with support 401 thereby holding the handle in the passage 407. Handle 408 may be removed from passage 407 by moving handle 408 down out of the passage 407. Spring 413 will return to its initial position in engagement with round bottoms 412.

Figure 17:
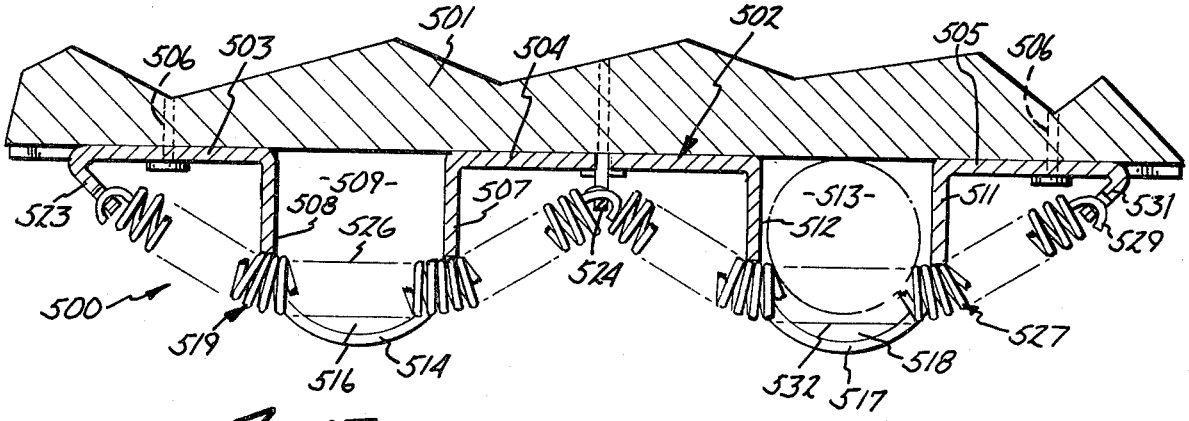
FIG. 17 is a sectional view taken along the line 17—17 of FIG. 16.

Referring to FIGS. 16 and 17, there is shown a fifth modification of the holder of the invention indicated generally at 500. Holder 500 can hold one or more objects, such as hand tools having elongated handles. Holder 500 is attached to a support structure 501 with a plurality of fasteners 506, such as nails, screws, nuts and bolts, and the like. Holder 500 has plate means indicated generally at 502 engageable with support structure 501. Plate means 52 have three support members 503, 504, and 505. Fasteners 506 extend through suitable holes in support members 503, 504, and 505 and into support structure 501.

A first tubular member or body 507 is joined to support members 503 and 504. Body 507 has an inside wall 508 and a passage 509. Passage 509 has open ends and accommodates a handle. A second tubular member or body 511 is located laterally of the first body 507. Second body 511 has an inside wall 512 and a passage 513. Passage 513 has open ends and accommodates a second handle or object.

First body 507 has edges 514 formed by removing a section of the body 507 to provide an opening 516. The opening 516 is in the front side of wall 508 and is in communication with passage 509. Edges 514 diverge from approximate mid-sections of opposite sides of wall 408 and are joined at a rounded bottom.

Second body 511 has edges 517 providing an opening 518. The edges 517 are formed by cutting a section of the body 511 thereby providing opening 518 open to passage 513. Edges 517 diverge outwardly from opposite sides of wall 512 and define the opening 518 in the wall 512.

A first biasing means indicated generally at 519 extends across opening 516. Biasing means 519 is an elongated elastic member shown as a coil spring. The coil spring is under tension and has end hooks 521 and 522. Hook 521 is connected to a short tab 523 joined to support member 503. The opposite end of coil spring has hook 522 connected to an anchor or tab 524 located in the mid-portion of support member 504. Tab 524 can be a bent up portion of support member 504. The coil spring has a mid-section 526 that extends across the passage 509 and serves as a biasing means to hold a handle in passage 509. Spring portion 526 biases the handle into frictional holding engagement with the support structure 501.

A second biasing means indicated generally at 527 is a coil spring that extends across opening 518. The opposite ends of biasing means are secured to support members 504 and 505 which hold the biasing means 527 under tension. The coil spring has end hooks 528 and 529. Hook 528 is connected to anchor 524. Hook 529 is connected to a tab 531 on support member 505. The mid-section 532 of the spring spans passage 513 and serves as a biasing means to hold a handle located in passage 513 in frictional engagement with support structure 501. Biasing means 519 and 527 can be a continuous coil spring secured at opposite ends to the tabs 523 and 531. The spring can be located under a tab or anchor 524 so that separate portions 526 and 532 of the spring will extend across passages 509 and 513.

Plate means 502 and bodies 507 and 511 can be formed from a single blank member, such as metal, plastic, and the like. Bodies 507 and 511 can be U-shaped sections with their cutouts forming the openings 516 and 518. Tabs 523, 524, and 531 can be bent up portions of the support members 503, 504, and 505.

While there has been shown and described several embodiments of the invention, it is understood that changes in the size, material, biasing means, and shape of the holder and the use of the holder with tubular or rod-like members may be made by those skilled in the art without departing from the invention. The invention is defined in the following claims.

The embodiments of the invention in which an exclusive property or privilege is claimed are defined as follows:

1. An apparatus for holding an object having an elongated generally cylindrical handle comprising: first means adapted to be attached to a support structure, a tubular member attached to the first means, said tubular member having an inside wall providing a linear passage to accommodate the handle, said tubular member having open opposite ends aligned with the passage whereby the handle can extend through the passage of the tubular member, and said tubular member having edge means providing an opening in the tubular member open to a side of said passage between the open ends of the tubular member, said edge means comprising a first edge and a second edge, said first and second edges diverging outwardly from opposite side portions of the tubular member and surrounding said opening; spring means extended across said opening engageable with the first and second edges, said spring means engageable with the handle when the handle is in the passage to hold the handle in fixed relation to the tubular member; and third means connecting the spring means to the first means.

2. The apparatus of claim 1 wherein: the first means is a generally flat member attached to the tubular member and located transversely of the tubular member.

3. The apparatus of claim 1 including: flanges connected to the first means adapted to be attached to the support structure.

4. The apparatus of claim 3 wherein: the flanges include pairs of flanges adapted to be attached to separate portions of the support structure.

5. The apparatus of claim 1 wherein: said inside wall has an arcuate shape.

6. The apparatus of claim 1 wherein: said inside wall has a cylindrical shape.

7. The apparatus of claim 1 wherein: said first and second edges have concave rounded bottom portions and outwardly diverging side portions, said spring means having portions located in said concave rounded bottom portions.

8. The apparatus of claim 1 wherein: said spring means is a coil spring extended under tension across said opening.

9. The apparatus of claim 8 wherein: said coil spring has opposite ends connected to the third means connecting the spring means to the first means.

10. The apparatus of claim 8 wherein: said coil spring has a mid-section located in said passage and engageable with said handle.

11. The apparatus of claim 8 wherein: said third means connecting the spring means to the first means include tab means located adjacent opposite sides of the tubular member, said coil spring having ends connected to the tab means.

12. The apparatus of claim 1 wherein: the third means connecting the spring means to the first means include tab means secured to the first means.

13. The apparatus of claim 1 wherein: the tubular member has second edge means providing a second side opening open to said passage, and a second spring extended across said second opening engageable with the handle, said first and second springs concurrently engageable with said handle to hold said handle in said passage of the tubular member, and means connecting the second spring to the first means.

14. The apparatus of claim 13 wherein: said first and second edge means are longitudinally spaced from each other along the length of the tubular member.

15. The apparatus of claim 12 wherein: each of said spring means is a coil spring extended under tension across said first and second openings.

16. The apparatus of claim 15 wherein: each coil spring has a mid-section engageable with said handle.

17. The apparatus of claim 13 wherein: said second edge means has first and second edges that diverge outwardly from opposite side portions of the tubular member.

18. The apparatus of claim 17 wherein: said edges of the second edge means have concave rounded bottom portions and outwardly diverging side portions.

19. The apparatus of claim 13 wherein: said means connecting the second spring means to the first means include tab means connected to the second spring means.

20. The apparatus of claim 19 wherein: said second spring means has ends connected to the second tab means.

21. The apparatus of claim 1 wherein: the tubular member has second edge means providing a plurality of openings open to the side of the passage, said spring means comprising a plurality of springs extended across said openings.

22. The apparatus of claim 21 wherein: said springs comprise coil springs extended under tension across said openings.

23. The apparatus of claim 22 wherein: each coil spring has a mid-section located in a passage and engageable with said handle.

24. The apparatus of claim 21 wherein: each of said second edge means has a pair of edges that diverge outwardly from opposite side portions of the tubular member providing said openings.

25. The apparatus of claim 24 wherein: each of said pair of edges has concave rounded bottom portions and outwardly diverging side portions.

26. An apparatus for holding an object comprising: first means adapted to be connected to support structure; body means connected to the first means, said body means having a wall and open opposite ends, said wall providing a passage for accommodating at least a part of the object, and edge means in the wall providing an opening to a side of said passage between the ends of the body means, said edge means comprising a first edge and a second edge, said first and second edges diverging outwardly from opposite side portions of the body means and surrounding said opening; biasing means extended across said opening engageable with the edges and the object to hold the object in the passage of the body means; and means connecting the biasing means to the first means.

27. The apparatus of claim 26 wherein: the first means is a plate member extended generally transverse of the longitudinal axis of the passage in the body means.

28. The apparatus of claim 26 including: flanges on the first means adapted to be attached to support structure.

29. The apparatus of claim 28 wherein: the flanges include pairs of flanges adapted to be attached to separate portions of the support structure.

30. The apparatus of claim 26 wherein: the body means has an arcuate wall.

31. The apparatus of claim 26 wherein: the body means is a tubular member having an end open to the passage.

32. The apparatus of claim 26 wherein: said edges have concave rounded bottom portions and outwardly diverging side portions.

33. The apparatus of claim 26 wherein: said biasing means is a coil spring extended under tension across said opening.

34. The apparatus of claim 33 wherein: said coil spring has a mid-section located in said passage engageable with the object.

35. The apparatus of claim 33 wherein: said first means has tab means located adjacent opposite sides of the body means, said coil spring having ends connected to the tab means.

36. The apparatus of claim 26 wherein: said first means has tab means, said biasing means having means connected to the tab means.

37. The apparatus of claim 26 including: further edge means in the wall providing additional openings to said passage, and further biasing means extended across the additional openings engageable with the object.

38. The apparatus of claim 37 wherein: said biasing means comprise coil springs extended under tension across said openings.

39. The apparatus of claim 37 wherein: the further edge means in the wall forming the openings comprise a plurality of pairs of edges.

40. The apparatus of claim 39 wherein: each of said pairs of edges diverges outwardly from opposite side portions of the wall providing said openings.

* * * * *

UNITED STATES PATENT AND TRADEMARK OFFICE

CERTIFICATE OF CORRECTION

PATENT NO. : 4,286,717

DATED : September 1, 1981

INVENTOR(S) : James O. Liesinger

It is certified that error appears in the above-identified patent and that said Letters Patent are hereby corrected as shown below:

Column 6, line 7, "41" should be -- 411 --.

Column 6, line 51, "52" should be -- 502 --.

Signed and Sealed this

Tenth Day of November 1981

[SEAL]

Attest:

GERALD J. MOSSINGHOFF

Attesting Officer

Commissioner of Patents and Trademarks